US011116319B1

(12) United States Patent
Hsiao et al.

(10) Patent No.: US 11,116,319 B1
(45) Date of Patent: Sep. 14, 2021

(54) SEAT

(71) Applicant: CHIA CHI YA ENTERPRISE CO., LTD., Tainan (TW)

(72) Inventors: Yun-Cheng Hsiao, Tainan (TW); Shih-Wei Chou, Tainan (TW)

(73) Assignee: CHIA CHI YA ENTERPRISE CO., LTD., Tainan (TW)

( * ) Notice: Subject to any disclaimer, the term of this patent is extended or adjusted under 35 U.S.C. 154(b) by 0 days.

(21) Appl. No.: 16/918,362

(22) Filed: Jul. 1, 2020

(51) Int. Cl.
*A47C 7/14* (2006.01)
*A47C 7/02* (2006.01)

(52) U.S. Cl.
CPC ..... *A47C 7/024* (2013.01); *A47C 7/14* (2013.01)

(58) Field of Classification Search
CPC ..... A47C 7/024; A47C 7/14
USPC ..... 297/312
See application file for complete search history.

(56) References Cited

U.S. PATENT DOCUMENTS 564,588 A * 7/1896 Burgess ..... B62J 1/005 297/312
606,818 A * 7/1898 Best ..... B62J 1/005 297/312 X
621,140 A * 3/1899 Reuter ..... A47C 7/024 297/312
656,854 A * 8/1900 Nord ..... B62J 1/005 297/312 X
749,865 A * 1/1904 Jarvis ..... F41A 23/38 297/312 X
2,018,721 A * 10/1935 Abraham ..... A47C 23/0435 297/312 X
2,132,291 A * 10/1938 Fitos ..... A47C 7/14 297/314 X
2,482,996 A * 9/1949 Wisby ..... A47C 7/029 297/312
2,799,323 A * 7/1957 Berg ..... A47C 3/025 297/312
3,058,778 A * 10/1962 Campbell ..... A47C 3/0252 297/452.5
3,080,195 A * 3/1963 Berg ..... A47C 7/14 297/312
3,784,148 A * 1/1974 Hill ..... A47C 3/025 248/582
5,024,485 A * 6/1991 Berg ..... A47C 3/025 297/312 X
5,288,127 A * 2/1994 Berg ..... A47C 3/025 297/312 X (Continued)

*Primary Examiner* — Rodney B White
(74) *Attorney, Agent, or Firm* — Birch, Stewart, Kolasch & Birch, LLP

(57) ABSTRACT

A seat has a base, two seat cushions disposed above the base, and two supporting members mounted on the seat cushions and connected to the base. Each one of the supporting members has multiple supporting elements. Each one of the supporting elements has a guiding rod and a spring. The guiding rod is mounted on the base and is screwed into a corresponding one of the seat cushions. The spring is disposed around the guiding rod. Two ends of the spring abut against the base and the corresponding one of the two seat cushions. In use, the spring can generate different degrees of compression and provide different degrees of supporting force. Deviation of the spring is limited by the guiding rod to avoid excess of the deviation and ensure sufficient support. The seat has both the support and the cushioning performance to improve sitting comfort.

10 Claims, 8 Drawing Sheets

(56) References Cited

U.S. PATENT DOCUMENTS

| | | | | | |
|---|---|---|---|---|---|
| 5,577,801 | A * | 11/1996 | Glockl | A47C 7/024 | 297/312 X |
| 5,580,128 | A * | 12/1996 | Johnson | A47C 7/021 | 297/312 X |
| 5,713,632 | A * | 2/1998 | Su | A47C 7/024 | 297/312 |
| 5,913,568 | A * | 6/1999 | Brightbill | A47C 3/025 | 297/312 X |
| 6,079,782 | A * | 6/2000 | Berg | A47C 7/024 | 297/312 X |
| 6,279,998 | B1 * | 8/2001 | Chu | A47C 1/023 | 297/338 |
| 6,866,340 | B1 * | 3/2005 | Robertshaw | A47C 7/024 | 297/312 |
| 7,100,983 | B1 * | 9/2006 | Gant | A47C 3/025 | 297/314 |
| 7,387,339 | B2 * | 6/2008 | Bykov | A47C 7/14 | 297/312 |
| 7,416,253 | B2 * | 8/2008 | Kim | A47C 7/14 | 297/312 |
| 10,194,754 | B2 * | 2/2019 | Choi | G05B 15/02 | |
| 2007/0252419 | A1 * | 11/2007 | Takahashi | A47C 3/026 | 297/312 |
| 2008/0265641 | A1 * | 10/2008 | Kim | A47C 7/024 | 297/312 |
| 2013/0057038 | A1 * | 3/2013 | Gloeckl | A47C 9/002 | 297/312 |

* cited by examiner

SEAT

BACKGROUND OF THE INVENTION

1. Field of the Invention

The present invention relates to a seat, and more particularly to a seat with adjustable support according to need.

2. Description of Related Art

A conventional seat has a base and two sponge cushions mounted on a top surface of the base. A user sits on the conventional seat, and the two sponge cushions respectively support a left hip and a right hip of the user. When sitting posture of the user is changed, pressures stressed on the two sponge cushions may be different, and deformations of the two sponge cushions may be different as well to fit the user. However, the support of the seat is only provided by the two sponge cushions and is insufficient.

For increasing the support of the conventional seat, another seat is applied and has the base, a seat cushion, and multiple oscillating members. The seat cushion is mounted on the base and has a board and a cushioning body mounted on the board. The oscillating members are mounted between the base and the seat cushion. Each one of the oscillating members has an oscillating plate, a first pivoted portion, and a second pivoted portion. The oscillating plate is located between the base and the board. The first pivoted portion is mounted on the oscillating plate and is tiltably connected to the base. The second pivoted portion is mounted on the oscillating plate and is tiltably connected to the base. When the sitting posture of the user is changed, the seat cushion can move relative to the base by the oscillating members. However, each one of the oscillating members can provide sufficient support by the first pivoted portion and the second pivoted portion, but cushioning performance of the oscillating members is not good.

For improving the cushioning performance, still another seat has the base, the seat cushion, and multiple buffer members. The seat cushion is mounted on the base and has the board and the cushioning body mounted on the board. The base has multiple assembling recesses and multiple positioning protrusions. The assembling recesses are formed on a bottom surface of the base. Each one of the positioning protrusions is formed on an inner-top surface of one of the assembling recesses. The buffer members are respectively disposed in the assembling recesses. A bottom end of each one of the buffer members abut against the base. A top end of each one of the buffer members abut against the board around a corresponding one of the positioning protrusions. In use, the buffer members can provide good cushioning performance. However, there is a gap formed between each one of the buffer members and a corresponding one of the assembling recesses. The bottom end of each one of the positioning protrusions does not protrude out of a bottom surface of the board. Thus, the positioning protrusions cannot effectively guide the buffer members to compress vertically. The buffer members are easy to laterally deviate excessively to decrease the support.

To overcome the shortcomings, the present invention provides a seat to mitigate or obviate the aforementioned problems.

SUMMARY OF THE INVENTION

The objective of the invention is to provide a seat that can solve the drawback that the support and the cushioning performance of the conventional seats are not good.

The seat of the present invention has a base, two seat cushions, and two supporting members. The base has multiple through holes formed through the base. The two seat cushions are disposed above the base and are laterally arranged. Each one of the seat cushions has a front half section, a rear half section, a board disposed above the base, a cushioning body mounted on a top surface of the board, and a frame structure mounted on a bottom surface of the board. Each one of the two supporting members is mounted on the frame structure of a corresponding one of the two seat cushions, is connected to the base, and has multiple supporting elements. The supporting elements are respectively located at the front half section and the rear half section of the corresponding one of the two seat cushions.

Each one of the supporting elements has a guiding rod and a spring. The guiding rod is mounted on the base and has a head and a shank. The head is located on a bottom surface of the base. An outer diameter of the head is larger than a diameter of a corresponding one of the through holes. The shank is formed on the head, is movably inserted through the corresponding one of the through holes, and is screwed into the frame structure of the corresponding one of the two seat cushions. The spring is disposed around the shank of the guiding rod. Two ends of the spring respectively abut against the base and the frame structure of the corresponding one of the two seat cushions.

The seat is mounted on legs of a chair. When a user sits on the seat, the user's left hip and left thigh rest on one of the two seat cushions, and the user's right hip and right thigh rest on the other seat cushion. The two seat cushions move downwardly according to pressures stressed on the two seat cushions. In the movement of one of the supporting elements, the shank of the guiding rod moves downwardly relative to the base, and the spring is compressed along an axial direction of the shank to avoid deviation by the shank and provide good support.

In addition, the supporting elements of each one of the two supporting members are respectively located at the front half section and the rear half section of the corresponding one of the two seat cushions. According to the difference of the user's sitting posture and the change of the pressures stressed on the two seat cushions, the spring of each one of the supporting elements can generate different degrees of compression and provide different degrees of supporting force to form a multi-point support configuration and to increase support effectively. The spring can provide a cushioning performance simultaneously. The seat has both the support and the cushioning performance to improve sitting comfort.

Furthermore, in each one of the supporting elements, the shank of the guiding rod is screwed into the frame structure of the corresponding one of the two seat cushions. The guiding rod can be rotated according to the user's needs to adjust the support of the spring for satisfying individual differences.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
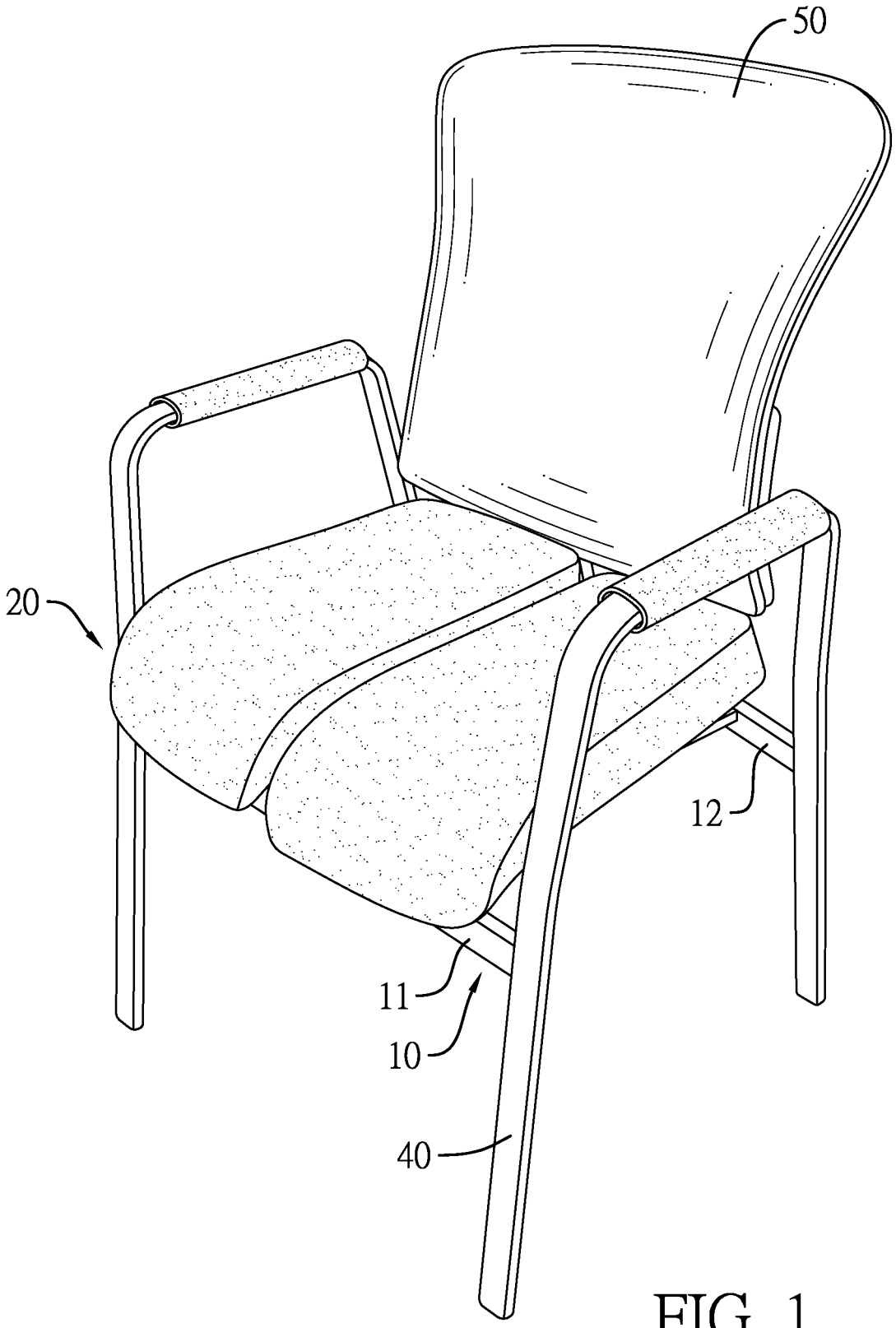
FIG. 1 is an operational perspective view of a seat in accordance with the present invention.

With reference to FIGS. 2 to 5, a seat in accordance with the present invention has a base 10, two seat cushions 20, and two supporting members 30. With reference to FIG. 1, the seat is mounted on legs 40 of a chair, and a seat back 50 of the chair is mounted on the seat adjacent to a rear end of the base 10.

Figure 2:
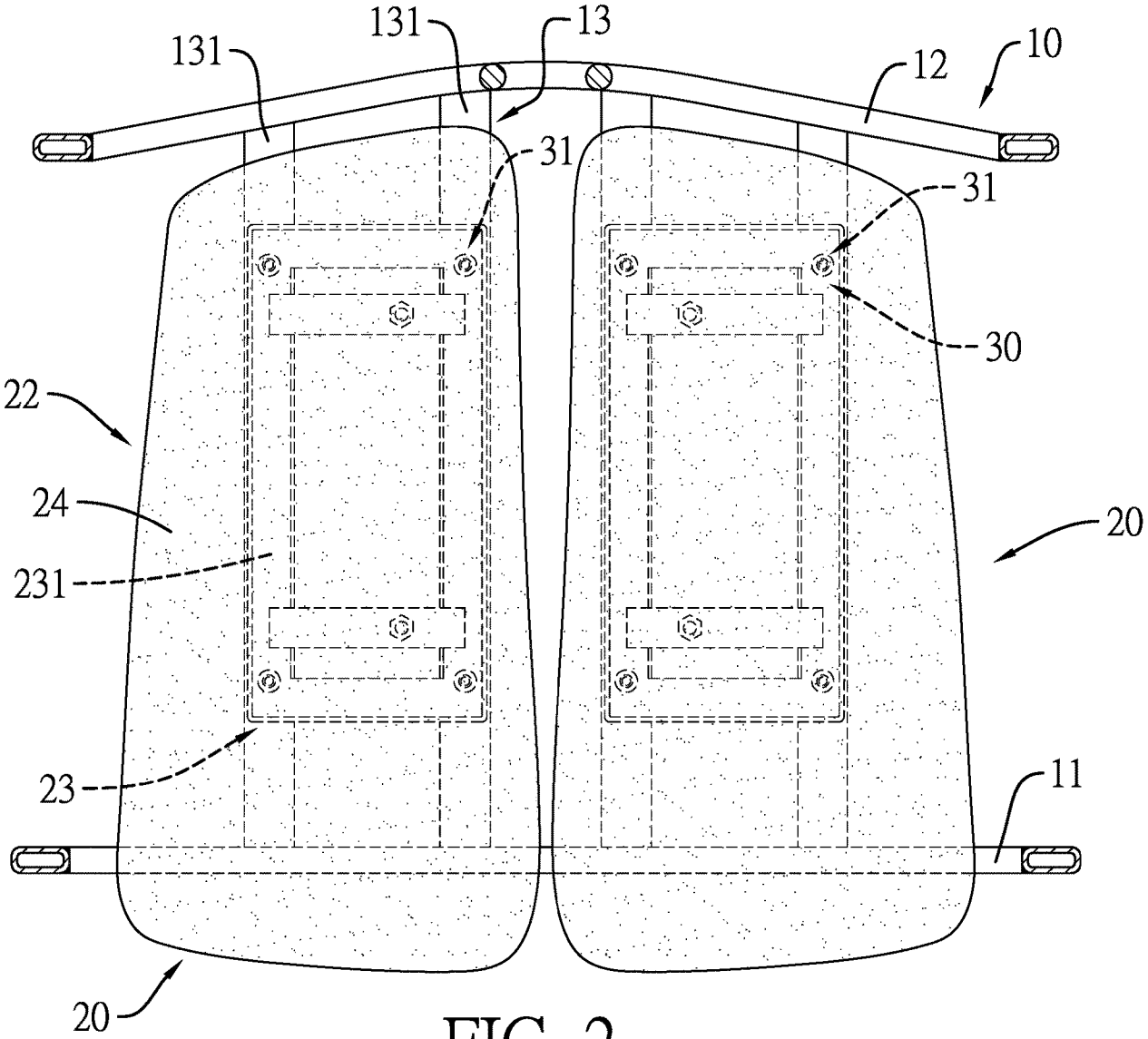
FIG. 2 is a partial cross sectional top view of the seat in FIG. 1.
Figure 3:
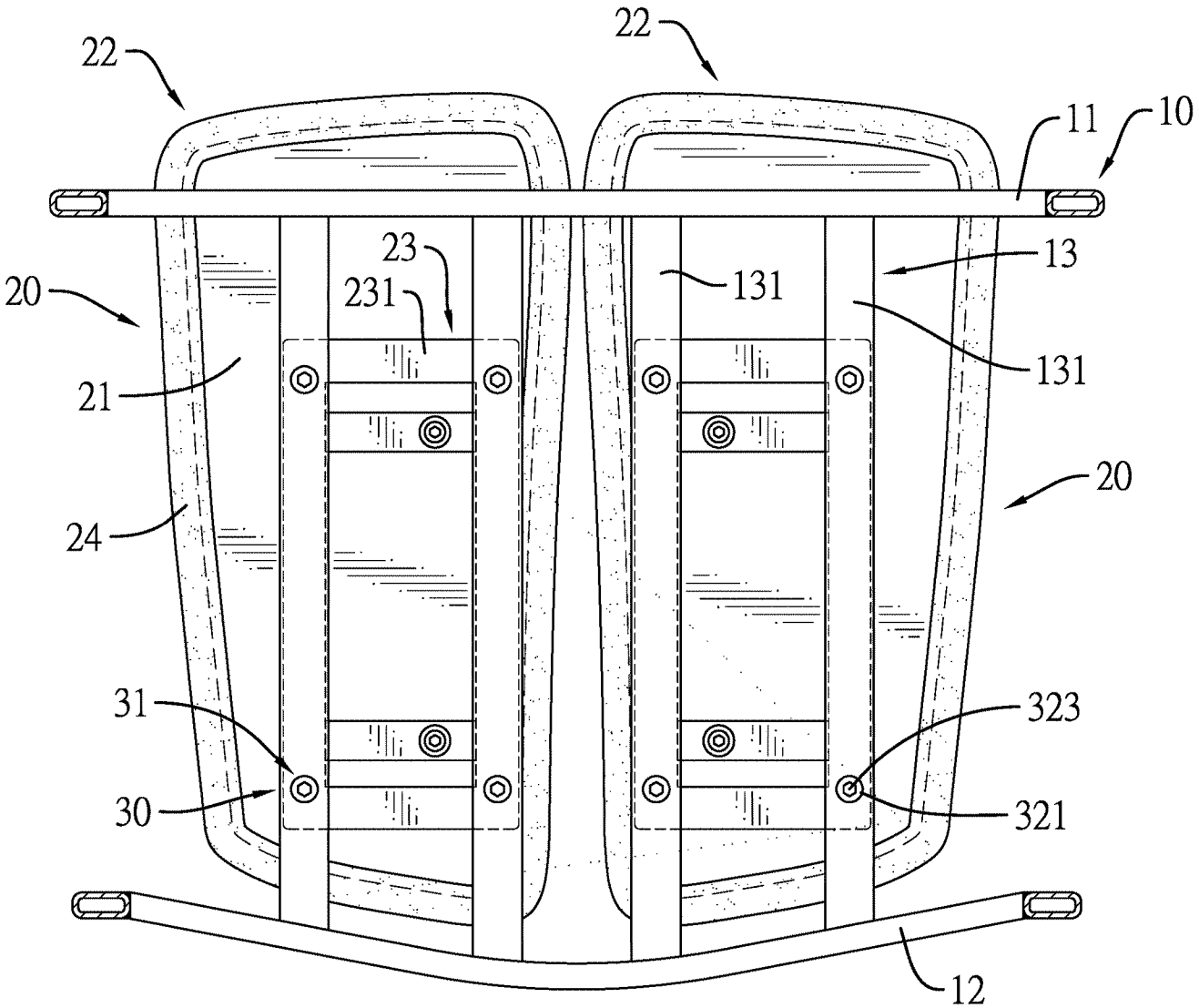
FIG. 3 is a partial cross sectional bottom view of the seat in FIG. 1.
Figure 5:
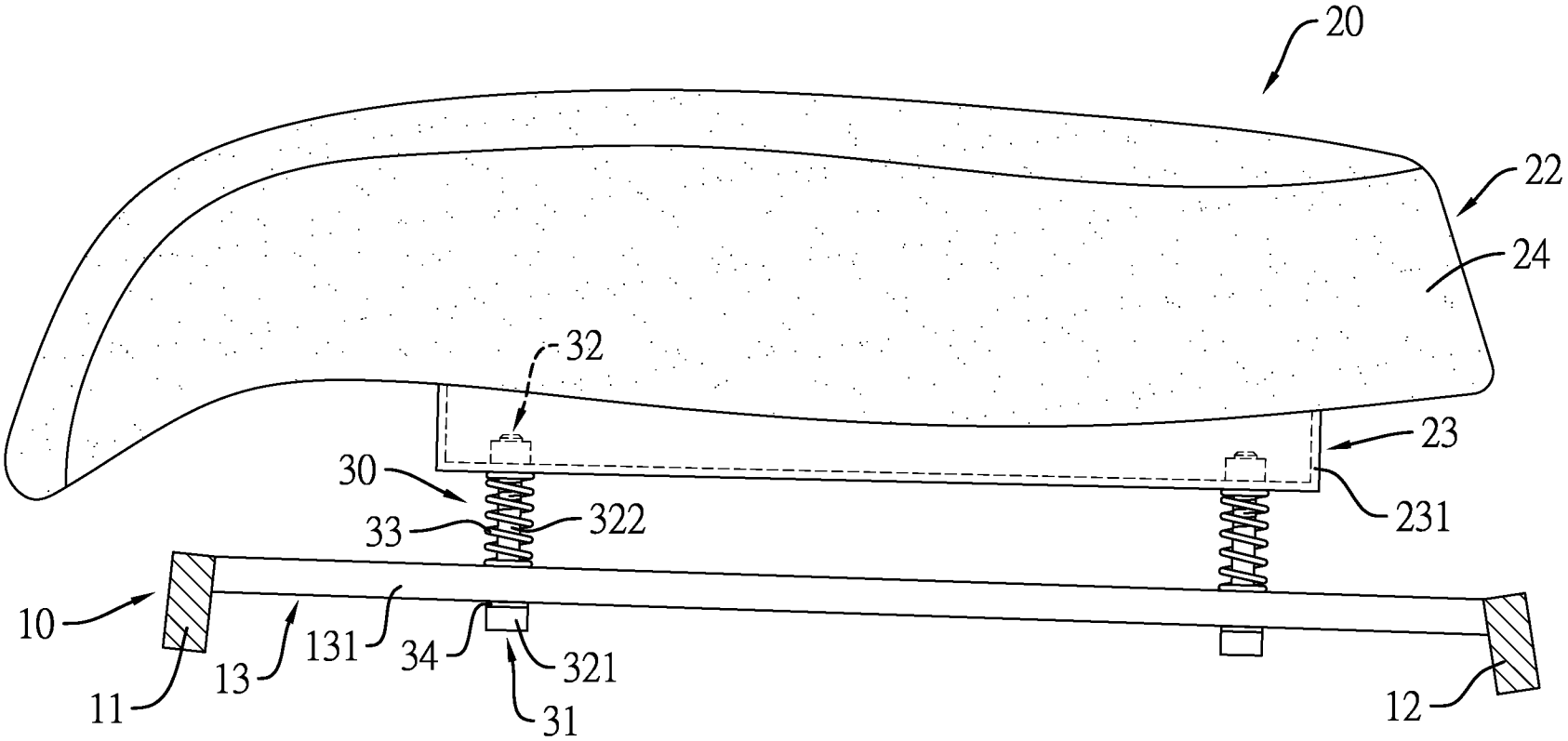
FIG. 5 is a partial cross sectional side view of the seat in FIG. 1.
Figure 6:
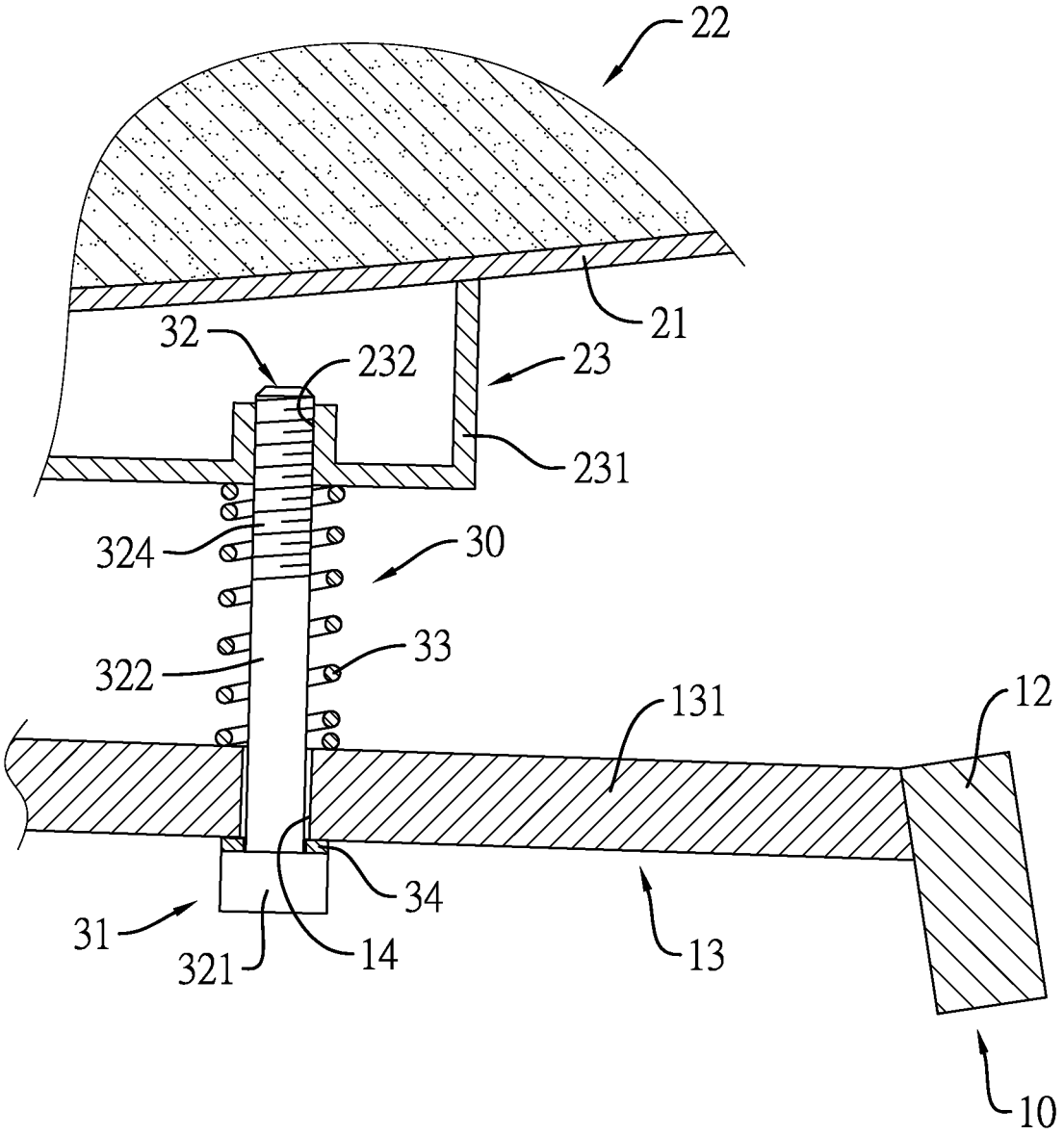
FIG. 6 is another partial cross sectional side view of the seat in FIG. 5.

With reference to FIGS. 5 and 6, the base 10 has multiple through holes 14 formed through the base 10. With reference to FIGS. 2 and 3, the base 10 has a front stretcher 11, a rear stretcher 12, and two connecting members 13. The two connecting members 13 are disposed at a spaced interval. Two ends of each one of the two connecting members 13 are respectively connected to the front stretcher 11 and the rear stretcher 12. The through holes 14 are formed through the two connecting members 13. Furthermore, each one of the two connecting members 13 has two connecting rods 131. The through holes 14 are formed through the connecting rods 131 of the connecting members 13.

Figure 4:
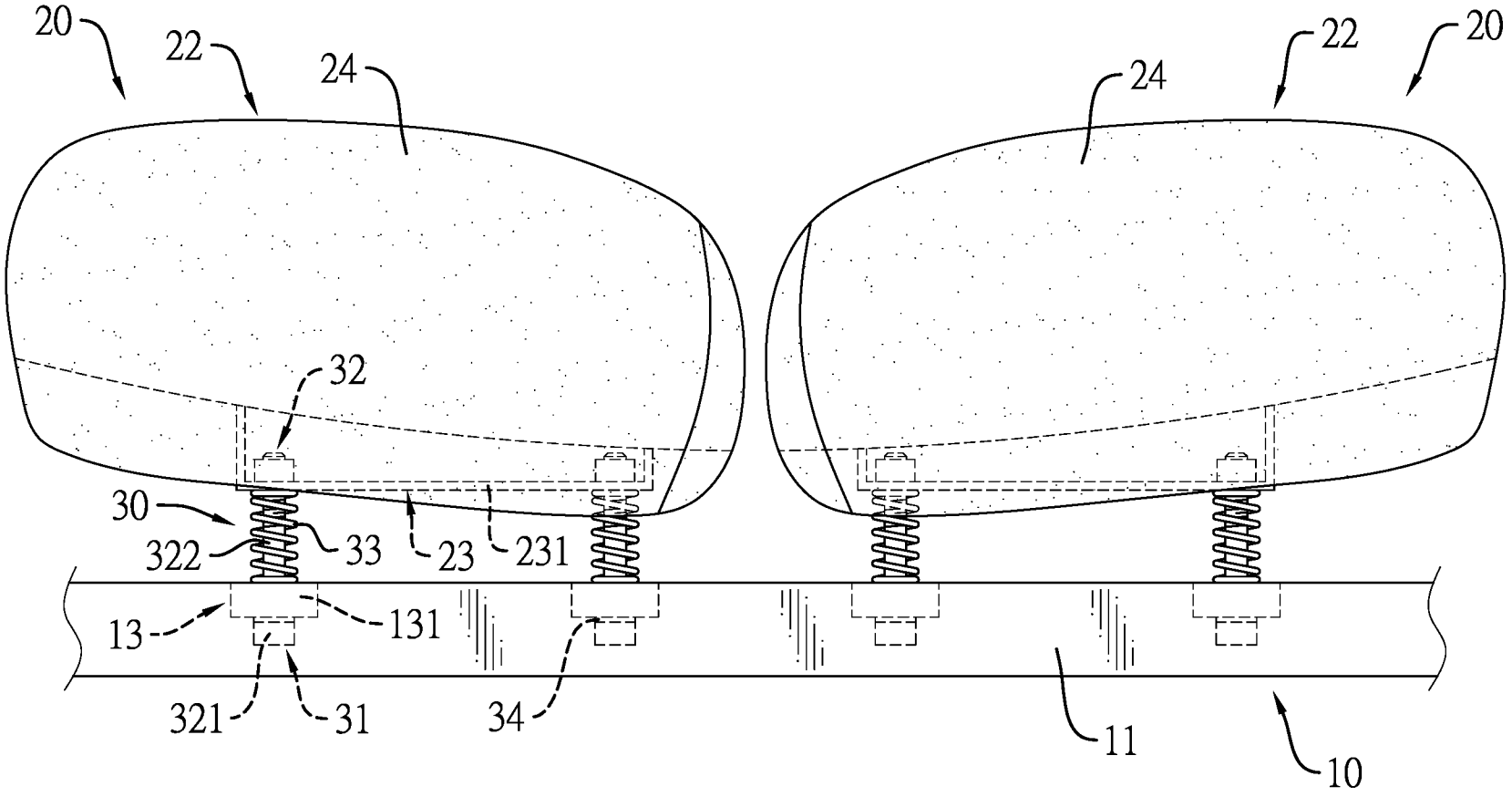
FIG. 4 is a front view in partial section of the seat in FIG. 1.

With reference to FIGS. 2 to 4, the two seat cushions 20 are disposed above the base 10 and are laterally arranged. Each one of the seat cushions 20 has a front half section, a rear half section, a board 21, a cushioning body 22, and a frame structure 23. The board 21 is disposed above the base 10. The cushioning body 22 is mounted on a top surface of the board 21. The frame structure 23 is mounted on a bottom surface of the board 21.

With reference to FIGS. 3 to 5, each one of the two supporting members 30 is mounted on the frame structure of a corresponding one of the two seat cushions 20, is connected to the base 10, and has multiple supporting elements 31. The supporting elements 31 are respectively located at the front half section and the rear half section of the corresponding one of the two seat cushions 20. With reference to FIGS. 5 and 6, each one of the supporting elements 31 has a guiding rod 32 and a spring 33. The guiding rod 32 is mounted on the base 10 and has a head 321 and a shank 322. The head 321 is located on a bottom surface of the base 10. An outer diameter of the head 321 is larger than a diameter of a corresponding one of the through holes 14. The shank 322 is formed on the head 321, is movably inserted through the corresponding one of the through holes 14, and is screwed into the frame structure 23 of the corresponding one of the two seat cushions 20. A gap is formed between a top end of the shank 322 and the board 21. The spring 33 is disposed around the shank 322 of the guiding rod 32. Two ends of the spring 33 respectively abut against the base 10 and the frame structure 23 of the corresponding one of the two seat cushions 20. With reference to FIG. 3, the guiding rod 32 of each one of the supporting elements 31 has a tool hole 323 formed on a bottom surface of the head 321.

With reference to FIG. 6, the frame structure 23 has a cushioning frame 231 and multiple threaded holes 232 formed on a bottom surface of the cushioning frame 231. The shank 231 has an outer threaded portion 324 formed around an outer surface of a top portion of the shank 231, and the outer threaded portion 324 is screwed into a corresponding one of the threaded holes 232. In addition, each one of the supporting elements 31 has a washer 34, and the washer 34 is mounted on a top surface of the head 321 of the guiding rod 32 and is disposed around the shank 322.

With reference to FIGS. 2 and 3, a number of the supporting elements 31 in each one of the two supporting members 30 is four, two of the four supporting elements 31 are disposed on the front half section of the corresponding one of the two seat cushions 20 and are laterally arranged, and the other two of the four supporting elements 31 are disposed on the rear half section of the corresponding one of the two seat cushions 20 and are laterally arranged.

With reference to FIGS. 3 and 4, the cushioning body 22 of each one of the two seat cushions 20 has a covering cloth 24, and the covering cloth 24 is fixedly mounted on the board 21. A covering range of the covering cloth 24 can be adjusted according to demand.

Figure 7:
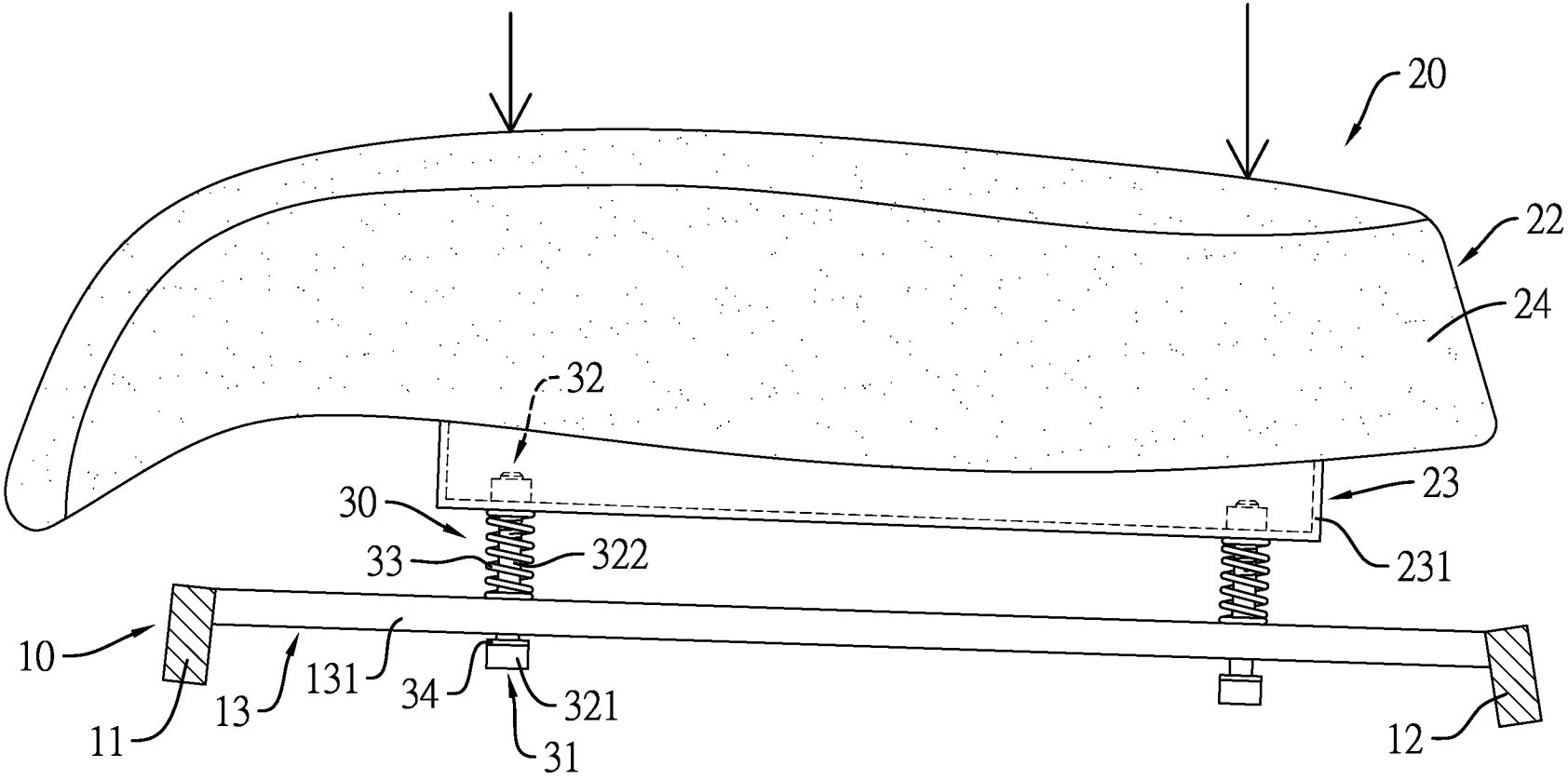
FIG. 7 is an operational side view of the seat in FIG. 5, showing the seat is pressed.
Figure 8:
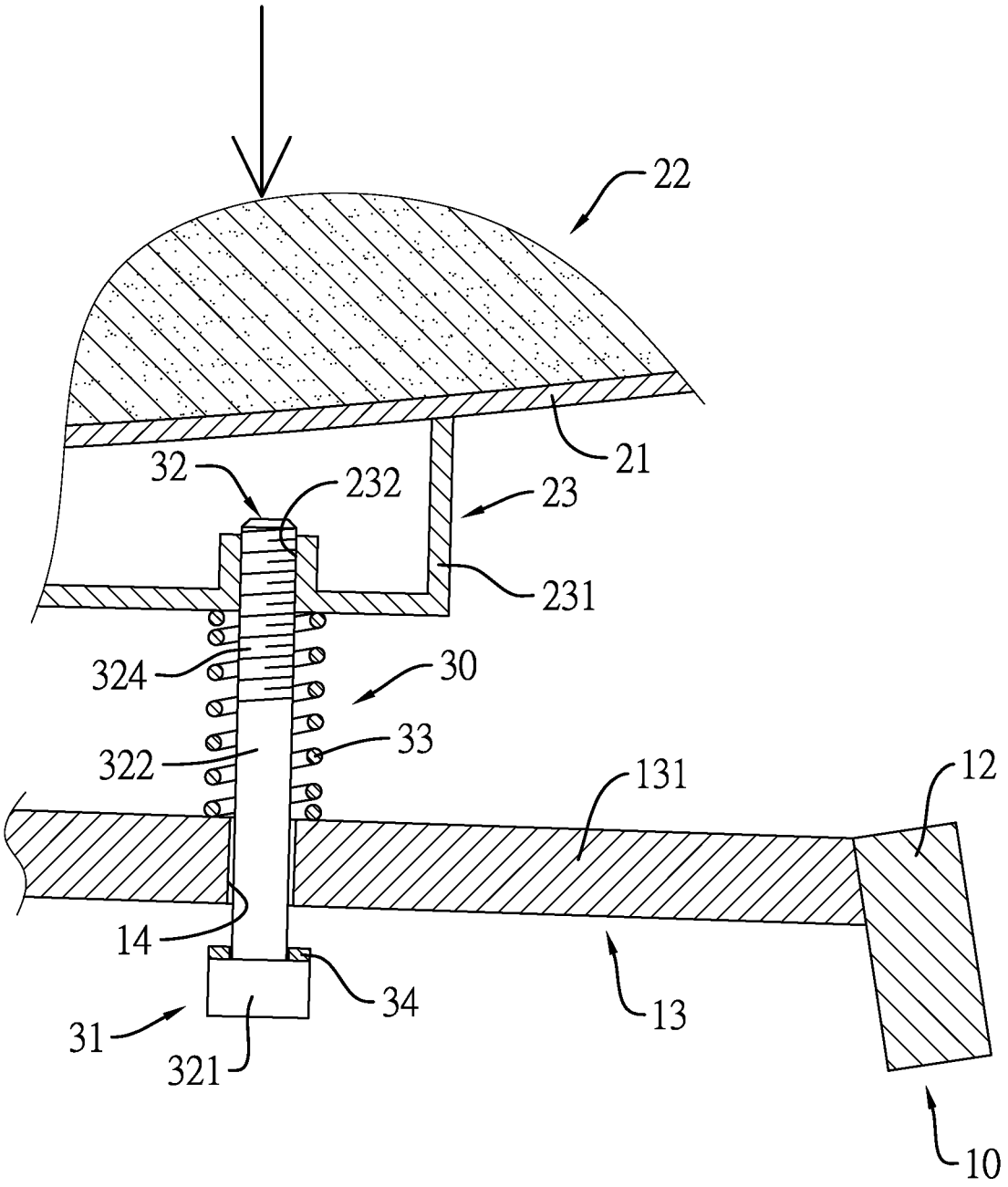
FIG. 8 is an operational and partial cross sectional side view of the seat in FIG. 6.

With reference to FIGS. 7 and 8, when a user sits on the seat, the user's left hip and left thigh rest on one of the two seat cushions 20, and the user's right hip and right thigh rest on the other seat cushion 20. The rear half section of each one of the two seat cushions 20 is pressed by the user' hip. The front half section of each one of the two seat cushions 20 is pressed by the user' thigh. With reference to FIG. 8, the two seat cushions 20 are pressed by the user, move downwardly, and drive the guiding rods 32 of the supporting elements 31. In the movement of one of the supporting elements 31, the guiding rod 32 moves downwardly relative to the base 10 along the corresponding one of the through holes 14 to compress the spring 33. The spring 33 is compressed along an axial direction of the shank 322 and provides a support force. Two ends of the shank 322 both extend out of the two ends of the spring 33. Degree of deviation of the spring 33 is limited by the shank 322 to avoid excess of the deviation and ensure good support.

With reference to FIGS. 2 and 3, the seat has the two seat cushions 20, and the supporting elements 31 are located at the front half section and the rear half section of each one of the two seat cushions 20. Pressing forces of the user's hip and the user's thigh are different. The springs 33 of the supporting elements 31 at different locations can generate different degrees of compression and provide different degrees of supporting force to form a multi-point support configuration and increase support effectively. When the user's sitting posture and the pressing force are changed, and deformations of the springs 33 of the supporting elements 31 at different locations are changed to adjust the supporting force. The spring can provide the support and a cushioning performance simultaneously. Each one of the seat cushions 20 and the corresponding one of the supporting members 30 can form the multi-point support configuration and form a supporting surface to increase stability of the support. The seat is more ergonomic by the multi-point support configuration. In each one of the supporting elements 31, the shank 322 of the guiding rod 32 is screwed into the frame structure 23 of the corresponding one of the two seat cushions 20. Sitting habits of different users vary, and needed amplitudes of support are different, too. The guiding rod 32 can be rotated according to the user's needs to adjust the support of the spring 33 for satisfying individual differences.

What is claimed is:

1. A seat comprising:

a base having multiple through holes formed through the base;

two seat cushions disposed above the base, and laterally arranged; each one of the seat cushions having a front half section;

a rear half section;

a board disposed above the base;

a cushioning body mounted on a top surface of the board; and a frame structure mounted on a bottom surface of the board, and having a cushioning frame and multiple threaded holes formed on a bottom surface of the cushioning frame; and two supporting members, each one of the two supporting members mounted on the frame structure of a corresponding one of the two seat cushions, connected to the base, and having multiple supporting elements respectively located at the front half section and the rear half section of the corresponding one of the two seat cushions, and each one of the supporting elements having a guiding rod mounted on the base and having a head located on a bottom surface of the base, wherein an outer diameter of the head is larger than a diameter of a corresponding one of the through holes; and a shank formed on the head, movably inserted through the corresponding one of the through holes, screwed into the frame structure of the corresponding one of the two seat cushions, and having an outer threaded portion formed around an outer surface of a top portion of the shank, wherein the outer threaded portion is screwed into a corresponding one of the threaded holes; and a spring disposed around the shank of the guiding rod, and two ends of the spring respectively abutting against the base and the frame structure of the corresponding one of the two seat cushions.

2. The seat as claimed in claim 1, wherein each one of the supporting elements has a washer, and the washer is mounted on a top surface of the head of the guiding rod and is disposed around the shank.

3. The seat as claimed in claim 2, wherein the guiding rod of each one of the supporting elements has a tool hole formed on a bottom surface of the head.

4. The seat as claimed in claim 2, wherein a number of the supporting elements in each one of the two supporting members is four; two of the four supporting elements are disposed on the front half section of the corresponding one of the two seat cushions and are laterally arranged; the other two of the four supporting elements are disposed on the rear half section of the corresponding one of the two seat cushions and are laterally arranged.

5. The seat as claimed in claim 4, wherein the cushioning body of each one of the two seat cushions has a covering cloth, and the covering cloth is fixedly mounted on the board.

6. The seat as claimed in claim 2, wherein the cushioning body of each one of the two seat cushions has a covering cloth, and the covering cloth is fixedly mounted on the board.

7. The seat as claimed in claim 1, wherein a number of the supporting elements in each one of the two supporting members is four; two of the four supporting elements are disposed on the front half section of the corresponding one of the two seat cushions and are laterally arranged; the other two of the four supporting elements are disposed on the rear half section of the corresponding one of the two seat cushions and are laterally arranged.

8. The seat as claimed in claim 7, wherein the cushioning body of each one of the two seat cushions has a covering cloth, and the covering cloth is fixedly mounted on the board.

9. The seat as claimed in claim 1, wherein the cushioning body of each one of the two seat cushions has a covering cloth, and the covering cloth is fixedly mounted on the board.

10. The seat as claimed in claim 1, wherein the guiding rod of each one of the supporting elements has a tool hole formed on a bottom surface of the head.

* * * * *